United States Patent [19]

Roberts

[11] 4,333,545

[45] Jun. 8, 1982

[54] BACK-FIRE RESISTANT LOCK SEAM FOR MUFFLER SHELLS

[75] Inventor: Peter Roberts, Mississauga, Canada

[73] Assignee: Thrush Incorporated, Rexdale, Canada

[21] Appl. No.: 187,263

[22] Filed: Sep. 15, 1980

[51] Int. Cl.[3] ..... F01N 7/18

[52] U.S. Cl. ..... 181/282; 138/151; 138/163; 29/157 R

[58] Field of Search ..... 181/243, 282, 247–251; 220/76–78, 453, 468; 138/151, 178, 163; 29/157 R

[56] References Cited

U.S. PATENT DOCUMENTS

| | | | |
|---|---|---|---|
| 2,187,431 | 1/1940 | Powell | 29/157.4 |
| 2,845,889 | 8/1958 | Jones | 113/34 |
| 2,966,226 | 12/1960 | Kalis | 181/243 |
| 3,064,336 | 11/1962 | Powers et al. | 29/157 |
| 3,581,842 | 6/1971 | Hall | 181/243 |

*Primary Examiner*—L. T. Hix
*Assistant Examiner*—Benjamin R. Fuller
*Attorney, Agent, or Firm*—Leon Arthurs; Kenneth M. Garrett

[57] ABSTRACT

A muffler wherein the shell comprises a metal sheet the ends of which are retained together in an interlocked joint has a shielding strip on the interior of the tube secured thereto in overlapping relation to the interlock. Preferably the sheet is a two ply, one end of the inner ply being retained in the joint, the other end forming the shielding strip, the edge of which is spot welded to the interior surface of the shell. The muffler is resistant to damage from back-fires.

11 Claims, 6 Drawing Figures

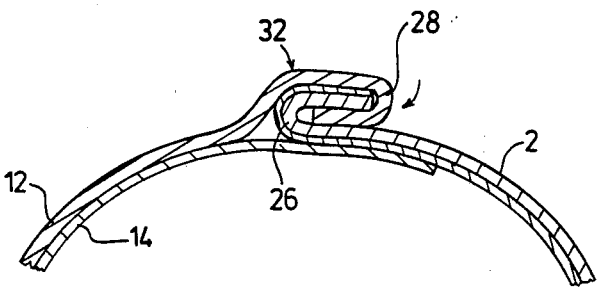
FIG.4.
FIG.6.
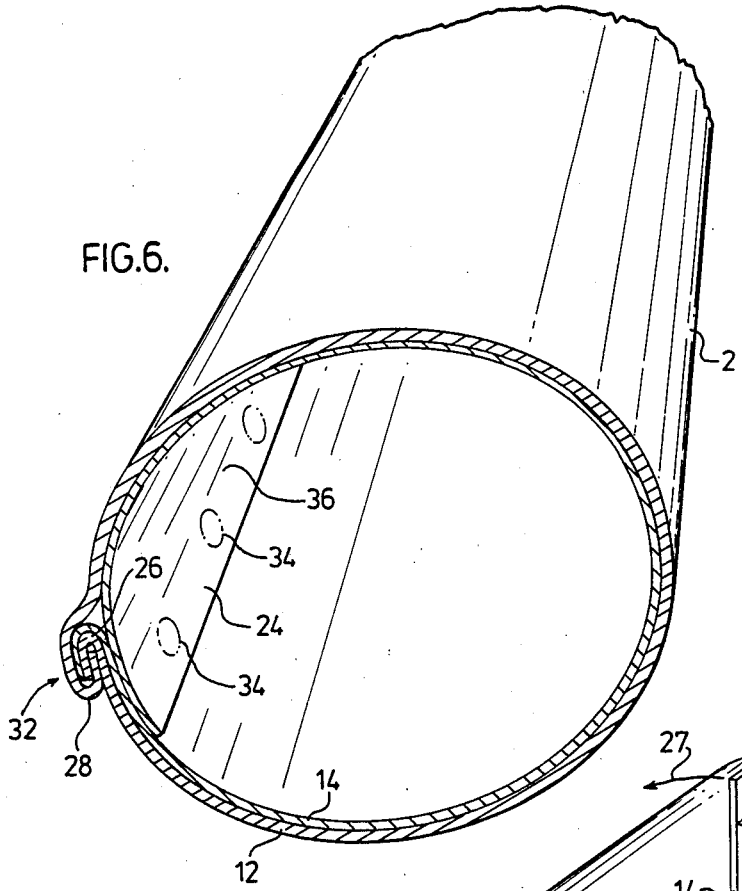
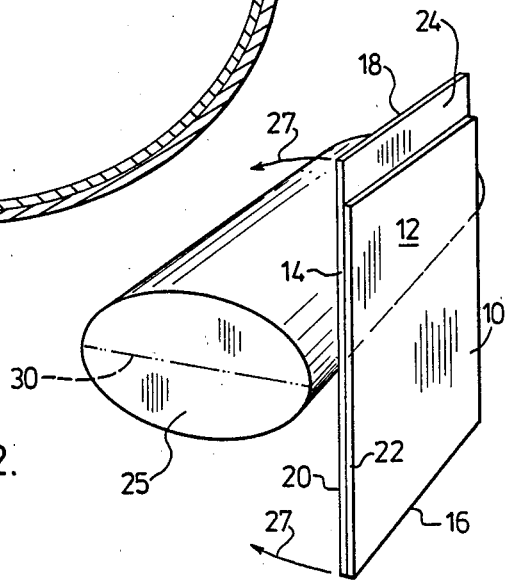
FIG.2.

BACK-FIRE RESISTANT LOCK SEAM FOR MUFFLER SHELLS

FIELD OF THE INVENTION

The invention relates generally to mufflers as used on internal combustion engines, with particular reference to an improved shell or casing construction for a muffler as visualized in which the sound attenuating elements are later installed.

BACKGROUND OF THE INVENTION

A muffler shell as contemplated is conventionally constructed of rectangular metal sheet which is rolled into a tubular form to bring two of its ends into mutually confronting approximation with each other. The borders of the confronting ends are folded in oppositely facing directions to provide complementary mateable hook elements which are interlocked with each other, rolled or otherwise compressed to provide a fairly rigid seam in a well known manner illustrated and described for example in JONES—U.S. Pat. No. 2,845,889.

Such seam is relatively thick, comprising four thicknesses of the metal sheet. The rolling process may be such as to form the seam generally on the exterior surface of the shell or the interior thereof, the former being here preferred as it leaves the shell interior relatively smooth for the accomodation of the sound attenuating elements to be subsequently installed therein.

It is known to form muffler shells from two plies of metal. The plies may be formed simultaneously and the ends hooked together in one seam. It is also known to form the plies separately and to join the ends in separate seams; such method is more time consuming, and has other disadvantages. For example, the seam of the inner ply tends to interfere with the fitting of the sound attenuating components where such seam locates internally. Where the seam locates on the exterior surface of the tube formed by the inner ply, this interferes with the fitting of the exterior ply unless special provision is made therefore.

As is well known, it is important that the seams as aforesaid be gas tight to prevent leakage of exhaust gases therethrough. Unfortunately, however, explosions—e.g. back-fires—occur within the muffler which tend progressively to spread such seams permitting gas flow therethrough and resulting, finally, in the total destruction or "blow out" of the mufflers.

Resort has been had to numerous expedients for combating this problem, but these have not proven entirely practical whether because of expense, ineffectiveness, complexity, or, in some instances, because they tend to detract from the essential sturdiness of the muffler shell.

The following U.S. prior art was developed in a patentability search of the invention, namely:

| | | |
|---|---|---|
| 85,742 | 1,081,348 | 2,187,431 |
| 2,333,887 | 2,845,889 | 3,064,336 |

SUMMARY OF THE INVENTION

The muffler shell of the present invention is very similar to that above described comprising a tubular sheet metal structure whose edges are hook mated and interlocked to provide a joint as aforesaid. The tubular structure is of course, open ended and closure elements are fixed to the respective ends with respective gas inlet and outlet facilities.

In contradistinction to the prior art, however, the invention disposes a narrow strip of metal on the interior wall of the shellas a bridge spanning and overlapping the joints substantially throughout its entire length. Said strip is firmly secured to the shell on opposite sides of the joint thus funtioning to shield the joint against the wedging forces resulting from back-fires or like internal explosions.

Expediently, a two ply metal sheet is rolled to a generally tubular form whereby ends thereof are brought into mutually confronting relationship. It should be clearly understood that the term "roll" is employed generically herein as being indicative of any and all manners as are known in metal working art for forming generally planar sheet into a generally tubular form. One confronting end of the metal sheet is folded to form a hook element which includes both of the plies. The other confronting end is formed into a complementary hook element, only the outer ply being so formed, however. The hook elements are interlocked in a seam, the inner ply of the other confronting end forming the strip underlaying the seam. The strip is spot welded at intervals adjacent the edge thereof to the interior surface of the muffler so as to firmly secure the seam, and thus provide said shield for the joint to protect the muffler against damage by internal explosion which is, of course, a major objective of the invention. Lesser objects of the invention include the provision of an integral shielding strip, and also the disposition of the shielding strip over the joint in a manner which will be effective to guard the joint against the effects of internal explosion and so to prevent damage as aforesaid; the whole being achieved economically and without deleteriously affecting the operation or durability of the muffler.

BRIEF DESCRIPTION OF THE DRAWINGS

A preferred construction embodying the principles of the invention is illustrated by way of example only in the annexed drawing wherein

FIG. 1—is an elevational view of a muffler shell only with parts thereof broken away to expose interior details;

FIG. 2—is an isometric view showing the rolling of a metal sheet around a mandrel;

FIGS. 3 and 4—are shell fragments progressively illustrating formation of the joint;

FIG. 5—an enlarged isometric view of one end of the muffler shell at an intermediate stage in its manufacture, and FIG. 6—is a view similar to FIG. 5 showing a portion of the interior of the muffler shell.

DESCRIPTION OF THE PREFERRED EMBODIMENT

Figure 1:
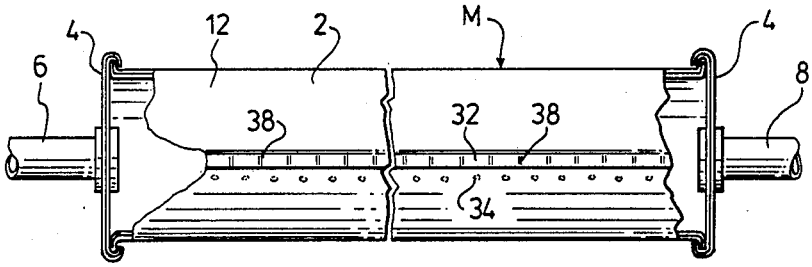
FIGS. 1, 3 and 5 are found on Sheet 1 thereof and FIGS. 2, 4 and 6 on Sheet 2.

A muffler M as herein visualized is generally illustrated in FIG. 1 with the tubular shell 2 thereof closed by closurers 4—4 fitted with exhaust inlet and outlet bushings 6 and 8. The interior parts of muffler M have been omitted from the drawing since they form no part of the invention.

Figure 3:
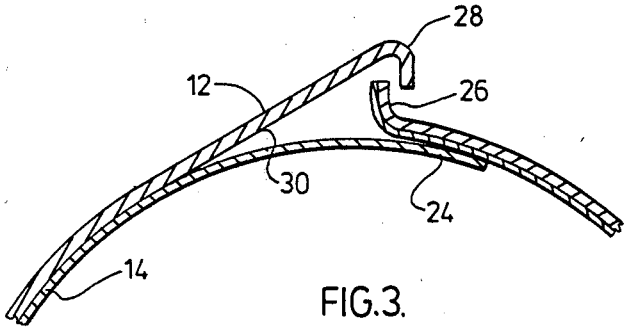

Referring now to FIG. 2, a metal sheet 10 comprises an outer ply 12 and an inner ply 14. The opposed ends 16, 18 of plies 12 and 14 are generally coextensive; the sides 20 of inner ply 14 are marginally greater in length than sides 22 of outer ply 12, the end of inner ply 14 projecting beyond that of outer play 12 in a tongue 24. Metal sheet 10 is rolled to a tubular shape by wrapping around an oval mandrel 25 as indicated by the arrows 27 such, that ends 16, 18 are in generally mutually confronting relationship. With reference to FIG. 3, end 16 is upset to form a hook element 26 which is substantially coextensive with the end, the hook element including both plies 12, 14 therein. The outer ply only of end 18 is upset along the length thereof to form a complementary hook element 28, with tongue 24 being left extended. It is found preferable that hook element 26 be turned up and complementary hook element 28 be down, each as illustrated, as the resulting joint appears to be stronger than where the ends are upset in the contrary sense. The joint is also found to be strengthened when formed along a line of minimum radius of mandrel 25, i.e. on the major axis 30 thereof. However, it should be appreciated that muffler M may be of other cross section than that specifically illustrated herein.

Figure 5:
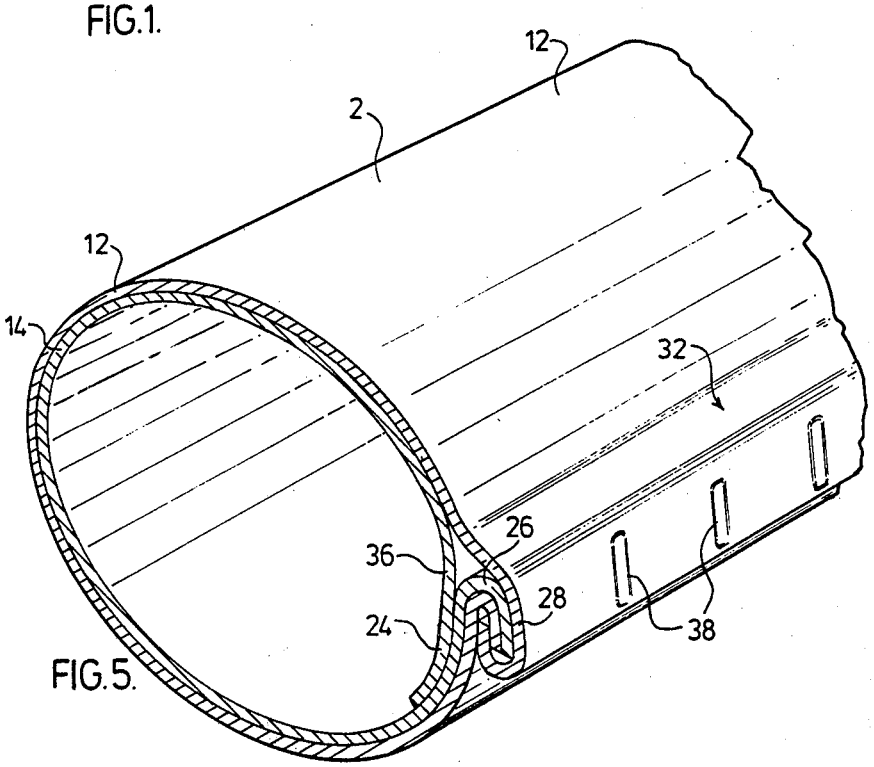

Hook elements 26, 28 are engaged and firmly interlocked, turning them under and over respectively, by rolling the joint along the length thereof to form a seam 32 generally raised on the exterior surface of shell 2, as best seen in FIGS. 4–6 inclusive. Tongue 24 generally overlaps and bridges seam 32, and is secured over the seam adjacent thereto in underlaying relationship therewith by spot welding 34 the edge portions thereof to the wall of shell 2, thereby forming a protective shield 36 over seam 32 throughout its entire length. Seam 32 is also preferably compressed at intervals 38 to strengthen it further.

It will be appreciated that in accordance with the preferred embodiment described, plies 12 and 14 of sheet 10 are formed simultaneously in rolling and seam jointing operations, in contradistinction to prior art method of separately forming the plies, with a concomitant saving in effort and more efficient utilization of equipment. In tests, mufflers having shells constructed as herein described have successfully withstood 25 back-fires in accordance with Ford Motor Company specification ES/D9AC/5230/BA without appreciable leakage at seam 32 of the muffler shell due, it is believed, to the shielding of the seam by shield 36 disposed as herein described.

What I claim is:

1. A muffler shell comprising:

a two ply sheet of metal formed into a tube, an interlock joining the ends of the sheet to retain it in tubular formation, said interlock comprising complementary hook elements located at said ends, a hook element at one said end including both plies therein, the hook element at the other said end including the outer ply only, the inner ply at the other said end extending beyond the hook element to overlap said interlock thereby forming a shield therefor.

2. A muffler as set forth in claim 1 wherein the extending portion of said inner ply is welded to said tube adjacent said interlock.

3. A muffler as set forth in claim 1 wherein said hook element at said other end is outwardly formed.

4. A muffler as set forth in claim 1, 2 or 3 wherein said interlock is raised on the outer surface of the shell of said muffler.

5. A muffler as set forth in claim 1, 2 or 3 wherein said shell is oval and said interlock locates at a side thereof of minimum radius.

6. A muffler as set forth in claim 1, 2 or 3 wherein the inner ply portion projecting beyond said hook element is in the form of a narrow strip.

7. Method for the construction of a muffler shell comprising:

providing first and second plies of a generally rectangular metal sheet;

rolling said metal sheet whereby opposed ends thereof are in generally mutually confronting relationship;

folding the metal sheet along one of the confronting ends to form a hook element including both said plies;

folding the outer ply only of the other confronting end to form a complementary hook element;

joining said hook elements and forming a seam, and spot welding the inner ply of the other confronting end along the edge thereof to the interior surface of said muffler so as to form a protective shield for said seam.

8. A method as set forth in claim 7, wherein said end forming said hook element including both said plies is folded upwardly to form said hook element.

9. A method as set forth in claim 8, wherein said metal sheet is rolled into a tubular form of oval cross-section, the ends locating along a side of the tube of minimum radius.

10. A method as set forth in claim 7, 8 or 9, wherein said seam is raised on the outer surface of the shell of said muffler.

11. A method as set forth in claim 7, 8 or 9 wherein said plies are generally coextensive along opposed ends thereof, the interior ply having a marginally greater dimension on the sides thereof such that said inner ply at said other confronting end projects beyond said outer ply to form a tongue.

* * * * *